US007716816B2

(12) United States Patent
Annis et al.

(10) Patent No.: US 7,716,816 B2
(45) Date of Patent: May 18, 2010

(54) METHOD OF MANUFACTURING A SWITCH ASSEMBLY

(75) Inventors: Jeffrey Ramsey Annis, Waukesha, WI (US); Robert Alfred Duchrow, Menomonee Falls, WI (US); Susan L Beneke, legal representative, Menomonee Falls, WI (US); James Peter Miller, Waukesha, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 11/856,326

(22) Filed: Sep. 17, 2007

(65) Prior Publication Data

US 2008/0073327 A1 Mar. 27, 2008

Related U.S. Application Data

(63) Continuation-in-part of application No. 11/526,040, filed on Sep. 22, 2006, now Pat. No. 7,551,050.

(51) Int. Cl.
*H01H 11/00* (2006.01)
*H01H 65/00* (2006.01)

(52) U.S. Cl. ..... 29/622; 29/602.1; 218/22; 218/27; 218/36; 218/40; 218/148; 335/16; 335/172

(58) Field of Classification Search ..... 29/622, 29/602.1; 218/22, 27, 36, 40, 148; 335/16, 335/35, 172
See application file for complete search history.

(56) References Cited

U.S. PATENT DOCUMENTS 2,467,937 A 4/1949 Jackson
4,237,355 A 12/1980 Fechant et al.
4,375,021 A 2/1983 Pardini et al.
4,451,718 A 5/1984 Yamagata et al.
4,470,027 A 9/1984 Link et al.
4,618,748 A 10/1986 Mueller
4,642,428 A 2/1987 Yoshiyasu et al.
4,654,490 A 3/1987 Leone et al.
4,654,491 A 3/1987 Maier et al.
4,656,446 A 4/1987 Chien et al.

(Continued)

FOREIGN PATENT DOCUMENTS

EP 1998349 12/2008

OTHER PUBLICATIONS

European Search Report.

(Continued)

*Primary Examiner*—Thiem Phan
(74) *Attorney, Agent, or Firm*—Boyle Fredrickson LLP; Alexander R. Kuszewski; John M. Miller

(57) ABSTRACT

A method of forming a switch assembly that includes a magnetic intensifier constructed to extend in generally close proximity to one of the stationary contact and the arc contact. During communication of power through the contactor assembly, the magnetic intensifier manipulates a magnetic field associated with current passing through the switch assembly and increases the magnitude of a magnetic force directed to the arc arrestor. Preferably, the magnetic intensifier is formed integrally with a turnback associated with one of the stationary contact or the arc contact. Such a construction simplifies the manufacture and assembly of the contactor assembly and provides efficient and repeatable arc suppression.

4 Claims, 6 Drawing Sheets

U.S. PATENT DOCUMENTS

| | | | | |
|---|---|---|---|---|
| 4,689,588 | A | 8/1987 | Murata et al. | |
| 4,743,720 | A | 5/1988 | Tekeuchi et al. | |
| 4,950,853 | A | 8/1990 | Crookston | |
| 5,075,520 | A | 12/1991 | Mueller et al. | |
| 5,097,104 | A | 3/1992 | Weichert | |
| 5,206,614 | A | 4/1993 | Carothers | |
| 5,210,385 | A | 5/1993 | Morel et al. | |
| 5,323,130 | A | 6/1994 | Arnold | |
| 5,475,193 | A | 12/1995 | Perdoncin | |
| 5,546,061 | A | 8/1996 | Okabayashi et al. | |
| 5,548,258 | A | 8/1996 | Kuboyama et al. | |
| 5,569,894 | A | 10/1996 | Uchida et al. | |
| 5,589,672 | A | 12/1996 | Uchida et al. | |
| 5,744,772 | A | 4/1998 | Fasano | |
| 5,807,130 | A | 9/1998 | Miller et al. | |
| 5,837,954 | A | 11/1998 | Asakawa et al. | |
| 6,060,674 | A | 5/2000 | Malingowski et al. | |
| 6,259,341 | B1 * | 7/2001 | Juds et al. | 335/35 |
| 6,265,685 | B1 | 7/2001 | Faure et al. | |
| 6,281,459 | B1 | 8/2001 | Munsch et al. | |
| 6,297,465 | B1 | 10/2001 | Groves et al. | |
| 6,300,586 | B1 | 10/2001 | Doughty et al. | |
| 6,373,014 | B1 | 4/2002 | Mitsuhashi et al. | |
| 6,384,702 | B1 | 5/2002 | Smith et al. | |
| 6,392,512 | B1 | 5/2002 | Ferree et al. | |
| 6,411,489 | B1 | 6/2002 | Kappel et al. | |
| 6,493,202 | B2 | 12/2002 | Kappel et al. | |
| 6,518,530 | B2 | 2/2003 | Heins et al. | |
| 6,703,575 | B1 | 3/2004 | Yamamoto | |
| 6,958,671 | B2 | 10/2005 | Chen et al. | |
| 7,081,596 | B2 | 7/2006 | Schneider et al. | |
| 2002/0050878 | A1 | 5/2002 | Ferree et al. | |
| 2006/0061920 | A1 | 3/2006 | Lam | |
| 2007/0290775 | A1 * | 12/2007 | McCoy et al. | 335/35 |

OTHER PUBLICATIONS

Extended European Search Report.

* cited by examiner

METHOD OF MANUFACTURING A SWITCH ASSEMBLY

CROSS-REFERENCE TO RELATED APPLICATIONS

This application is a continuation-in-part of U.S. patent application Ser. No. 11/526,040 filed on Sep. 22, 2006 now U.S. Pat. No. 7,551,050 titled "Contactor Assembly with Arc Steering System" and the disclosure of which is incorporated herein.

BACKGROUND OF THE INVENTION

The present invention is directed to electrical contactors and, more particularly, to an arc steering system for such contactors.

A contactor or circuit breaker is a type of current interrupting switch or severable electrical connection that is capable of substantially limiting the duration and the intensity of current flowing in a circuit experiencing a short circuit fault. Other severable electrical connections are commonly referred to as relays, disconnects, circuit breakers, switches, safety switches, enclosed circuit breakers, power circuit breakers, current-limiting circuit breakers, ground fault circuit breakers (GFCI's), and arc fault circuit interrupters (AFCI's). Understandably, these are but a few of the devices commonly referred to as switches or current switches or breakers. It is further appreciated that a severable electrical connection according to the present invention be provided as a manual or automatically operable switch. The switches defined by the present claims include all such switching configurations.

As one example of an implementation of the present invention, to limit the duration and the intensity of short-circuit currents, a circuit breaker quickly separates the contacts of the circuit breaker. The separation of the contacts while electrical current is flowing through the contactor results in an arc being formed between the contacts of the contactor. Prolonged arcing between the contacts can damage the mating surfaces of the contacts, can damage structures adjacent the contactor, and/or can result in the welding together of the contacts.

Arc damage to the mating surfaces of the contacts detrimentally affects the life of the contactor as well as the continued operability of the contactor. Irregularities in the surface of the contacts caused by arc damage results in contacts that do not fully close in a coplanar manner and in separations between the current carrying surfaces of the contacts when the contacts are closed. These irregularities mean that current that is communicated through the contactor is carried over a smaller surface area thereby generating localized current concentrations and thermal gradients in the contacts of the contactor assembly. Arcing can also cause irregularities that protrude above the preferably planar mating surfaces of the contacts. These irregularities tend to attract subsequent circuit termination arcs that further degrade the mating surface of the contact. Accordingly, during a short circuit condition, it is desirable to not only quickly separate the contacts but also to quickly transfer any resultant arc away from the contacts.

Among the devices for achieving desired quenching of the arc, the most typical is an arc arrestor which has an arc chute generally aligned along a given number of superimposed ferromagnetic plates. The plates are generally separated from one another and provided with projections or horns that extend toward the path of the arc drawn between the contacts. The plate configuration draws the arc into the arc chute where it is cooled and split up into a plurality of individual smaller arcs, or arclets. However, such a configuration allows the arc to maintain engagement with the contacts until the contacts are sufficiently separated that the resistance between the contacts is greater than the resistance between one contact and a plate of the arc arrestor. Accordingly, although such an arc arrestor aims to quickly quench a circuit termination arc, such arc arrestors inadequately address expedient transfer of the arc away from the contacts.

Still others have attempted to improve the transfer of the arc from the contacts to the arc arrestor through implementation of a slot motor magnet or a magnetic intensifier positioned proximate one of the contacts of the contactor assembly. As current flows through the contacts, a slot motor magnet generates a magnetic force on the arc that is directed toward the arc arrestor. Thus, during separation of the contacts, the magnetic field generated by the slot motor magnet directs the resultant arc toward the arc arrestor.

Such magnetic intensifiers occasionally result in the arc being attracted to the conductive material of the slot motor magnet damaging the slot motor assembly and possibly delaying movement of the arc away from the contacts. Others have attempted to prevent arcing to the slot motor magnet by encasing the magnet material of the slot motor magnet in a non-conductive material. Unfortunately, such modification increases the distance between the slot motor magnetic material and the contactor thereby reducing the magnitude of the magnetic force associated with the slot motor magnet. Accordingly, although such a modification minimizes the potential of arc attraction with the conductive material of the slot motor magnet, such modification also detrimentally affects the desired magnetic effect of the slot motor magnet.

SUMMARY OF THE INVENTION

The present invention provides a contactor having a magnetic field intensifier that, rather that encasing the slot motor magnet in an insulator and moving it away from the arc, moves the magnetic field intensifying structure closer to the arc by extending a magnetically reactive arm along a side of the contact. The arm is designed to attract the arc and to promote movement of the arc toward the suppressor. A combination of the shape of the arm to promote arc movement and the increased strength of the magnetic field provided by the arm, serves to minimize arc damage to the contact.

Specifically then, the present invention provides a switch assembly that includes a stationary contact, an arc contact, an arc arrestor, and a magnetic intensifier. The magnetic intensifier is constructed to be positioned in generally close proximity to one of the contacts of the switch assembly. During communication of power through the contactor assembly, the magnetic intensifier accentuates a magnetic field generated by a current passed through a turnback of one of the contacts and increases the magnitude of a magnetic force directed toward the arc arrestor. In one embodiment, the magnetic intensifier is formed as a pair of arms that extend from the turnback in close proximity to contact. Preferably, the intensifier and turnback are formed from a continuous piece of copper clad steel.

Therefore, in accordance with one aspect of the present invention, a magnetic intensifier for use in a switch for severing an electrical circuit is disclosed. The switch includes a pair of electrical contacts that separate along an axis and produce an arc along the axis between front surfaces of the contacts. At least one of the contacts provides a turnback wherein current to the contact passes along at least a partial loop passing in part behind the contact. The magnetic intensifier includes a magnetically responsive body that forms at least a portion of the turnback proximate the one contact. An arm extends from the magnetically responsive body beyond a side of one contact and proximate the one contact to manipulate magnetic flux formed by the current passing through the partial loop. Such a construction provides an intensifier assembly that can be formed integrally with the electrical components of the switch.

Another aspect of the invention disclosed a circuit interrupter assembly that has a first contact and a second contact that is movable between a first position and a second position. The first contact and second contact are electrically connected when the second contact is located in the first position and the first contact and the second contact are electrically separated when the second contact is located in the second position. A turnback is constructed to support one of the first contact or the second contact. An intensifier extends beyond a side of the turnback proximate the one contact and is configured to concentrate magnetic flux generated by current passing through the turnback.

A further aspect of the invention discloses a method of manufacturing a switch assembly. The method includes cutting a body from a metallic material. A turnback is formed by folding the body along a first fold line such that a first portion of the body overlies a second portion of the body. The body is folded along second and third fold lines that are oriented in crossing directions with the first fold line such that the turnback is flanked by a pair of arc rails which extend in a direction away from an area bound by the first and second portions of the body. The arc rails intensify the magnetic field associated with a current passing through the turnback. Such a construction simplifies the construction and assembly of the switch.

These and various other features, aspects, and advantages of the present invention will be made apparent from the following description and drawings.

BRIEF DESCRIPTION OF THE DRAWINGS

The drawings illustrate one preferred embodiment presently contemplated for carrying out the invention. In the drawings.

DETAILED DESCRIPTION OF THE PREFERRED EMBODIMENT

Figure 1:
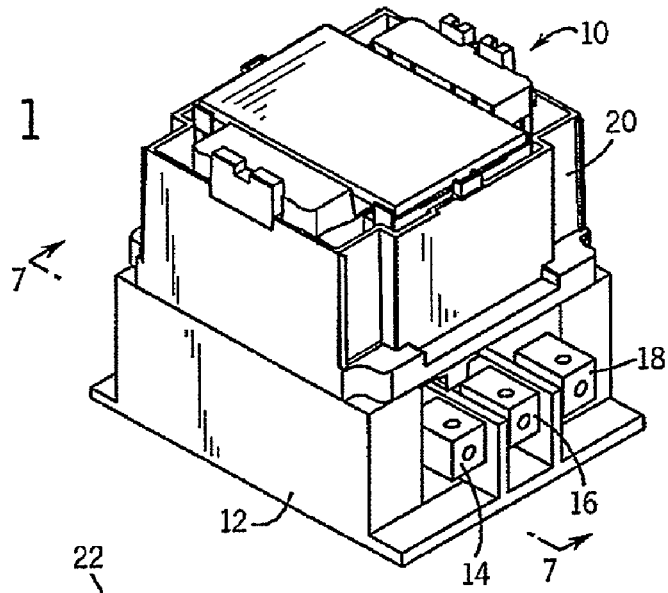
FIG. 1 is perspective view of a three-phase contactor assembly equipped with a magnetic field intensifier according to one embodiment of the present invention.

FIG. 1 shows an exemplary circuit interrupter or contactor assembly 10 according to the present invention. Contactor assembly 10 includes a housing 12 having a plurality of connections 14, 14', 16, 16', 18, and 18' passing therethrough. Understandably, it is appreciated that, as shown, contactor assembly 10 is configured as a three-phase contactor assembly and that other contactor assembly configurations, such as single phase, are envisioned and within the scope of the claims. It is recognized that the present invention is applicable for contactor assemblies having one contactor to a plurality of contactors, including more than three.

Figure 2:
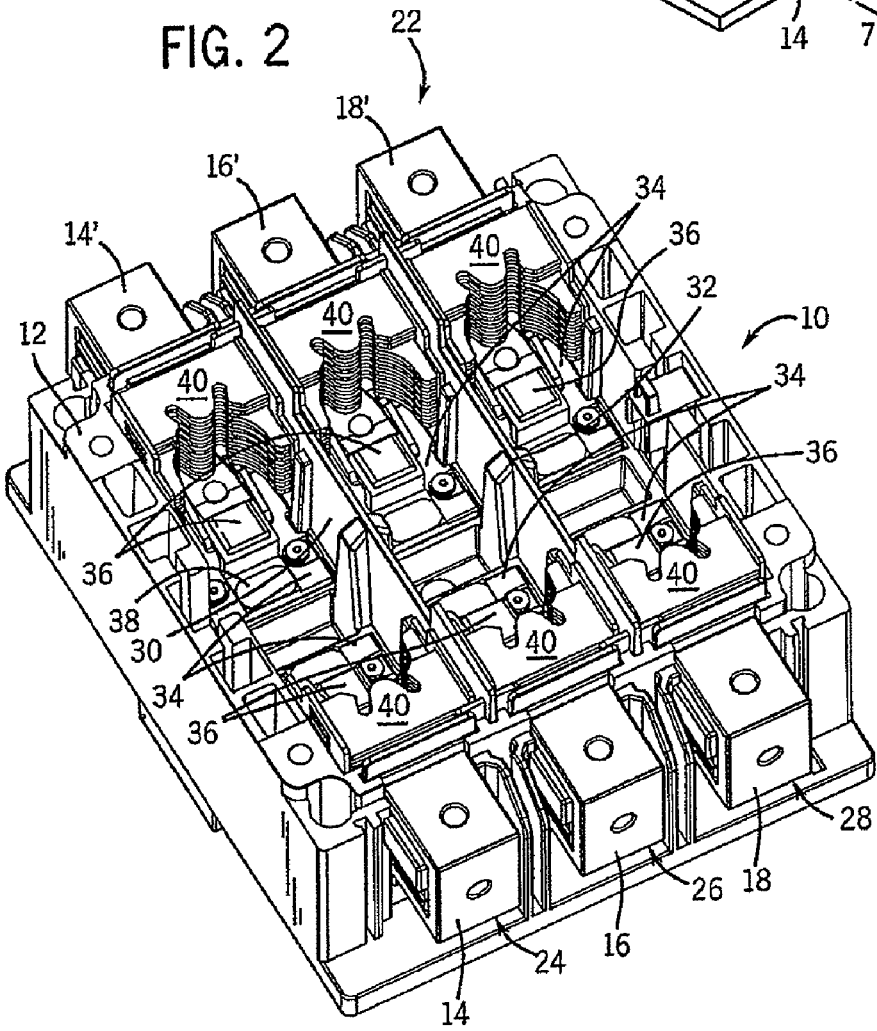
FIG. 2 is a top perspective view of the contactor assembly shown in FIG. 1 with a cover removed therefrom.

Cover 20 is constructed to engage housing 12 and generally encloses the electrical componentry disposed therebehind. As shown in FIG. 2, removing cover 20 from housing 12 exposes a fixed portion 22 of a plurality of severable electrical circuits 24, 26, 28 between connectors 14, 14'; 16, 16' and 18, 18'. Housing 12 includes a plurality of upstanding walls 30, 32 configured to isolate the conductive components of adjacent circuits 24, 26, 28. Each circuit 24, 26, 28 includes at least one stationary contact 34 electrically connected to at least one of connectors 14, 14', 16, 16', 18, 18'. Each stationary contact 34 includes a stationary arc contact or arc contact 36 and a stationary carry contact or carry contact 38. An arc arrestor 40 is positioned proximate each of the arc contacts 36 and is constructed to quench a circuit termination arc that is established at arc contact 36.

Figure 3:
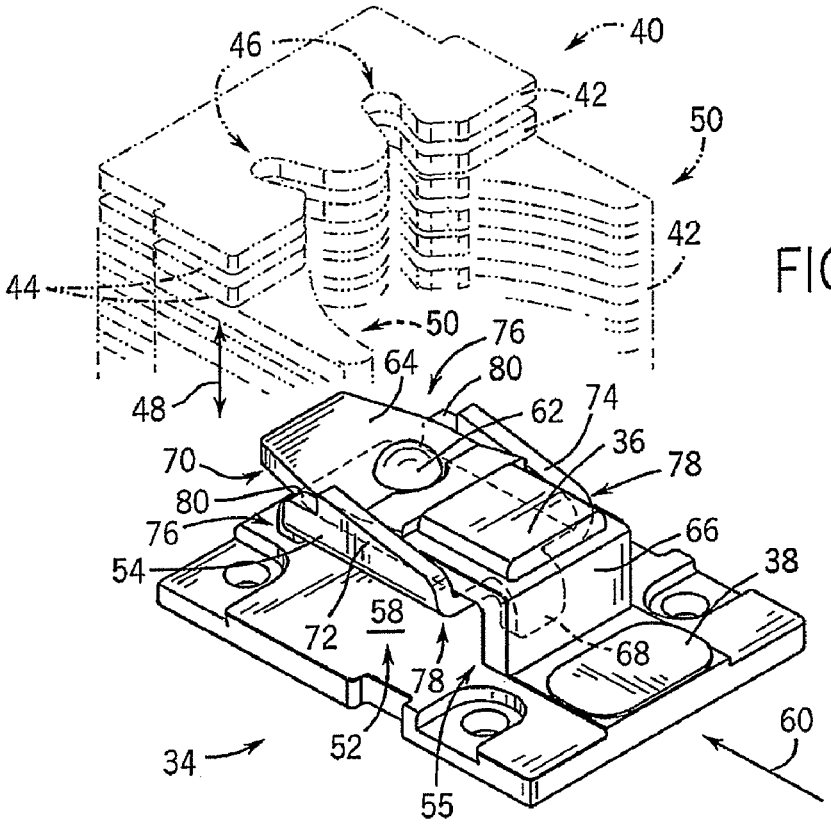
FIG. 3 is a perspective view of a stationary contact of the contactor assembly shown in FIG. 2.

As shown in FIG. 3, arc arrestor 40 includes a plurality of plates 42 that are constructed to be positioned in relatively close proximity to stationary contact 34. A gap 44 is formed between adjacent plates 42 such that, during quenching of a current termination arc, the current termination arc is divided into a plurality of arclets which are formed across gaps 44 between adjacent plates 42. The division of the current termination arc into a plurality of arclets reduces the temperature associated with the circuit termination arc and thereby encourages the collapse of the circuit termination arc.

A pair of channels 46 extends a length, indicated by arrow 48, of arc arrestor 40 and is configured to further enhance cooling of the arc arrestor. A plurality of optional arms 50 extends from a selected number of plates 42 and is configured to generally flank an upstanding portion 55 of stationary contact 34.

Contact 36 is positioned on top of a turnback 56 which provides a looping path of current from base 58 communicating and supporting the carry contact 36 to a cantilevered horizontal portion 64 supporting the contact 36. A vertical portion 66 of turnback 56 offsets horizontal portion 64 of turnback 56 from base 58.

A magnetic intensifier 54 is positioned between a turnback 56 and the base 58 of stationary contact 34. Passage of current through turnback 56 and base 58 of stationary contact 52 generates a magnetic force on an arc having a magnitude oriented generally in the direction indicated by arrow 60. Magnetic intensifier 54 is preferably a ferromagnetic material and serves to concentrate the magnetic field generated by current flow through the turnback 56 and thereby increases the magnitude of magnetic force 60 and maintains the same direction thereof. Alternatively, intensifier 54 could be constructed of the nonconductive ferromagnetic material such as a ceramic magnetic. A rivet 62 secures magnetic intensifier 54 to a horizontal portion 64 of turnback 56. An arm 68 extends from magnetic intensifier 54 toward base 58 and ensures snug engagement of magnetic intensifier 54 within an underside 70 of horizontal portion 64 of turnback 56.

A pair of projections, arms, ramps, or wings 72, 74 extend upward from magnetic intensifier 54 flanking horizontal portion 64 of turnback 56 to be positioned about opposite sides of arc contact 36. The wings 72, 74 extend between a first end 76 and a second end 78 of magnetic intensifier 54 providing a continuous magnetic path. The upper surface of each wing 72 and 74 provides a ramp with sharpened edges sloping upward as one moves away from the arm 68. A notch 80 is formed in wings 72, 74 proximate first ends 76 nearest the arc arrestor 40. As will be described further below with respect to FIGS. 8-10, wings 72, 74 ensure the repeatable transfer of a circuit termination arc away from arc contact 36.

Figure 4:
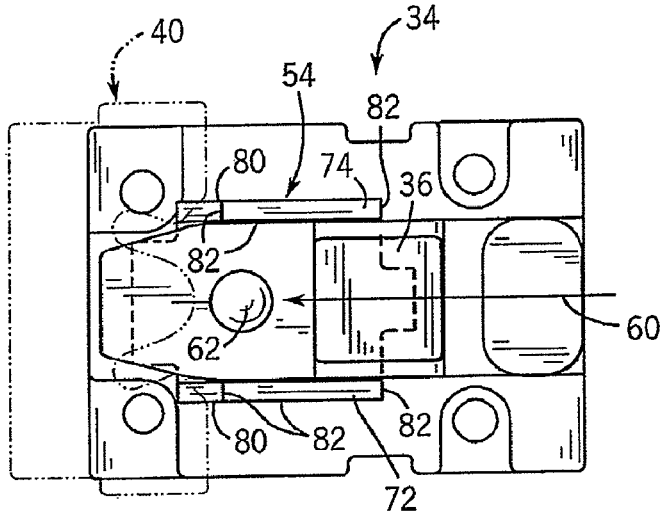
FIG. 4 is a top plan view of the stationary contact shown in FIG. 3.

As shown in FIG. 4, notches 80 of wings 72, 74 allow the relatively close engagement of stationary contact 34 with arc arrestor 40. Wings 72, 74 include a number of corners 82 that are generally positioned between arc contact 36 and arc arrestor 40. Corners 82, the wrapping of wings 72 and 74, and the amplification of magnetic force 60 cooperatively ensure the efficient and repeatable communication of a circuit termination arc away from arc contact 36 and toward arc arrestor 40. Additionally, the relatively close positioning of wings 72, 74 between arc contact 36 and arc arrestor 40 provide assist in the expedient transfer of a circuit termination arc from arc contact 36.

Figure 5:
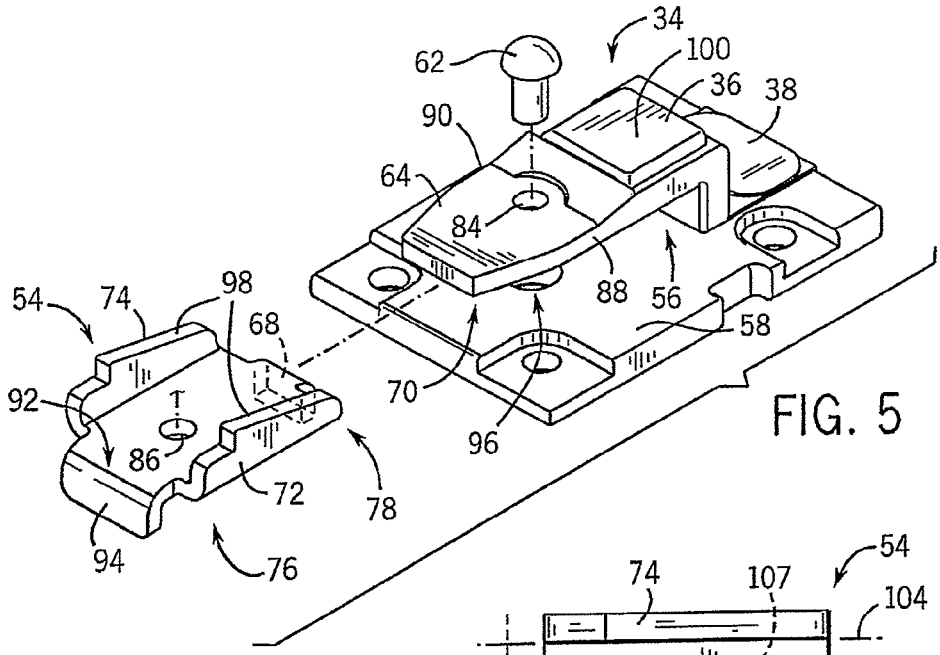
FIG. 5 is a perspective view of the stationary contact shown in FIG. 3 with the magnetic field intensifier removed therefrom.

As shown in FIG. 5, horizontal portion 64 of turnback 56 of stationary contact 34 includes an opening or hole 84 formed therein. A hole or recess 86 is also formed in magnetic intensifier 54 and constructed to allow fastening of the magnetic intensifier to horizontal portion 64 of turnback 56 via rivet 62. Understandably, other fastening or securing means such as crimping or screwing are envisioned and within the scope of the claims. It is further appreciated to simply friction secure magnetic intensifier 54 to turnback 56 through friction fitting such as with arm 68 or like structure. Wings 72, 74 are constructed to generally flank and extend above a pair of sides 88, 90 of horizontal portion 64 of turnback 56. Upper surface 92 of magnetic intensifier 54 snuggly engages underside 70 of turnback 56. Rivet 62, arm 68, and another arm 94 ensure the secure engagement of magnetic intensifier 54 within a space 96 between horizontal portion 64 of turnback 56 and base 58 of stationary contact 34. As shown in FIG. 5, when magnetic intensifier 54 is disposed within space 96, wings 72, 74 each form a ramp 98 which gradually extends above a face 100 of arc contact 36 between first end 76 and second end 78 of magnetic intensifier 54. As described further below, the construction of ramps 98 provide quick and repeatable separation of a circuit termination arc from arc contact 36.

Figure 6:
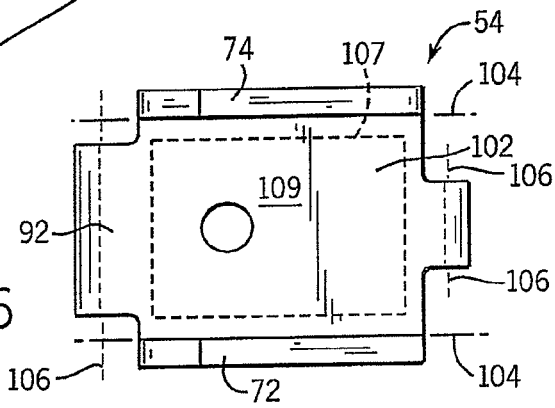
FIG. 6 is a plan view of the magnetic field intensifier shown in FIG. 5.

Referring to FIG. 6, stationary contact 34 includes a generally regular trapezoidal body 102 wound to form wings 72, 74. Body 102 is formed of a magnetic material, a ferromagnetic, or a rare earth material. The trapezoidal body is folded along fold lines 104, 106 that are generally perpendicular to one another. Wings 72, 74 form a pair of upstanding arc rails which generally flank a central portion 109 of base body 102. Positioning upper surface 92 of magnetic intensifier 54 adjacent underside 70 of stationary contact 34 generates a magnetic field force that is directed in a common direction with a direction of reduced resistance of wings 72, 74 as determined by a comparison of the distance between the movable arc contact and the stationary arc contact and the movable arc contact and the wings 72, 74. Optionally, a magnet 107 may be attached to the underside of magnetic intensifier 54 to further boost the magnetic field that serves to move the arc into the arc arrestor 40.

Figure 7:
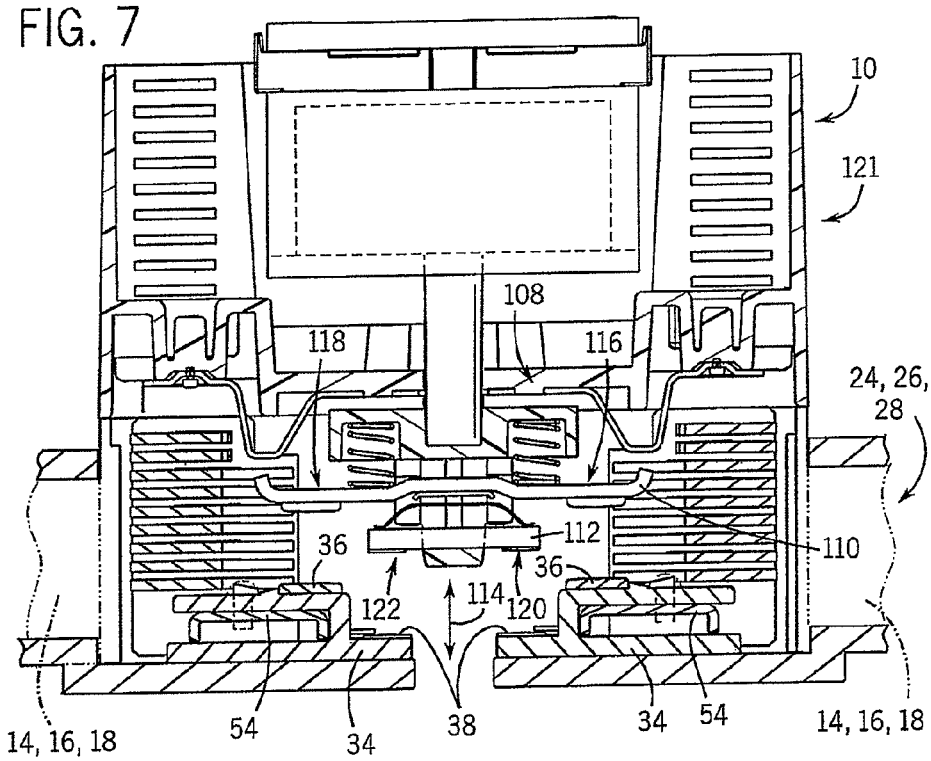
FIG. 7 is a cross-sectional elevational view of the contactor assembly taken along line 6-6 shown in FIG. 1.

FIG. 7 is an elevational cross-sectional view of circuit 24, 26, 28 of contactor assembly 10. FIGS. 7-11 depict an operational sequence of the movable elements of contactor assembly 10. Understandably, it is appreciated that contactor assembly 10 is constructed to selectively close an electrical circuit as well as automatically sever the electrical circuit when a ground fault is detected or when a user desires to sever the electrical circuit.

Figure 8:
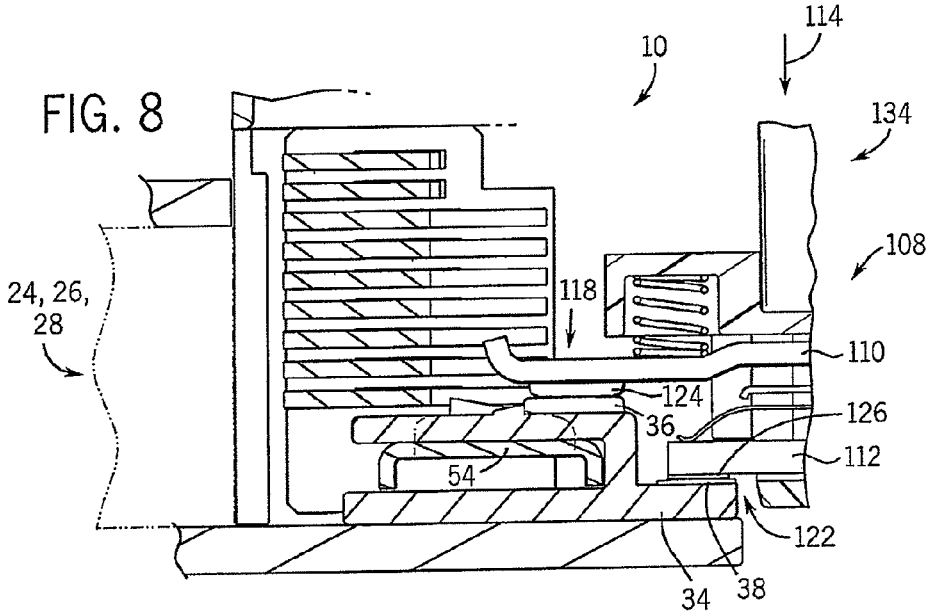
FIG. 8 is an elevational view of one side of the contactor assembly shown in FIG. 7 with the carry contacts and the arc contacts positioned to communicate current through the contactor assembly.

Referring to FIG. 7, a moveable contact assembly 108 includes an arc contact bridge 110 and a carry contact bridge 112 that are moveably connected to contactor assembly 10. Arc contact bridge 110 and carry contact bridge 112 are moveable in a direction, indicated by arrow 114 such that opposing ends 116, 118 of arc contact bridge 110 engage arc contacts 36 of stationary contacts 34 and opposing ends 120, 122 of carry contact bridge 112 engage adjacent carry contacts 38. As shown in FIG. 7, moveable contact assembly 108 is an open or nonconducting position 121 wherein electrical current is not communicated through the contactor assembly. As shown in FIG. 8, when it is desired to communicate power through contactor assembly 10, moveable contact assembly 108 is displaced in direction 114 such that arc contact 36 and carry contact 38 of stationary contact 34 electrically engage an arc contact 124 connected to arc contact bridge 110 and a carry contact 126 attached to carry contact bridge 112. Comparing FIGS. 7 and 8, it is shown that moveable contact assembly 108 is movable between the open circuit position shown in FIG. 7 and a closed or conducting position 134 shown in FIG. 8. As shown in FIG. 8, when desired or during normal power providing conditions, the movable arc contact 124 and movable carry contact 126 engage the stationary arc contact 36 and stationary carry contact 38. Accordingly, electrical power is communicated through both carry contact bridge 112 and arc contact bridge 110 of contactor assembly 10 when the contactor assembly is closed.

Figure 9:
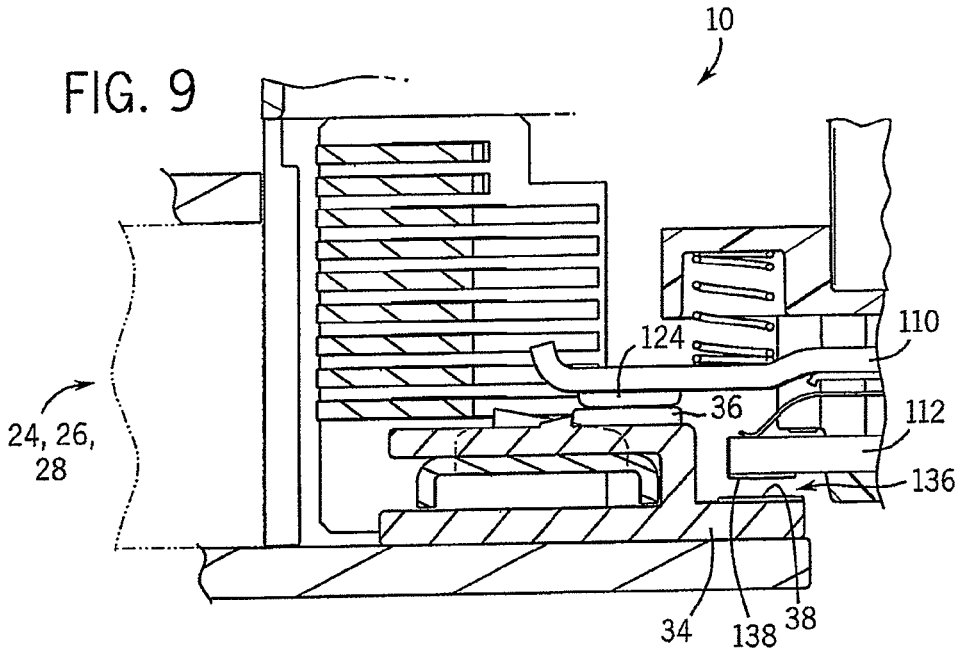
FIG. 9 is a view similar to that shown in FIG. 8 with the carry contacts separated so that current is only communicated through the arc contacts.

As shown in FIG. 9, when a non-conducting or open configuration of contactor assembly 10 is desired or a ground fault condition occurs, carry contact bridge 112 disengages or separates from carry contact 38 of stationary contact 34 thereby forming a gap 136 between stationary carry contact 38 and each of the moveable carry contacts 138. Current is still communicated through contactor assembly 10 via the engagement of arc contact 36 of stationary contact 34 and moveable arc contact 124 attached to arc contact bridge 110. Such a construction ensures that, during opening, or severing of the electrical connection, current is allowed to flow through arc contact bridge 110 after isolation of the carry contact bridge thereby ensuring any resultant circuit termination arc is formed between arc contacts 36, 124. Such operation maintains the mechanical and electrical integrity and operability of carry contacts 38, 138.

Figure 10:
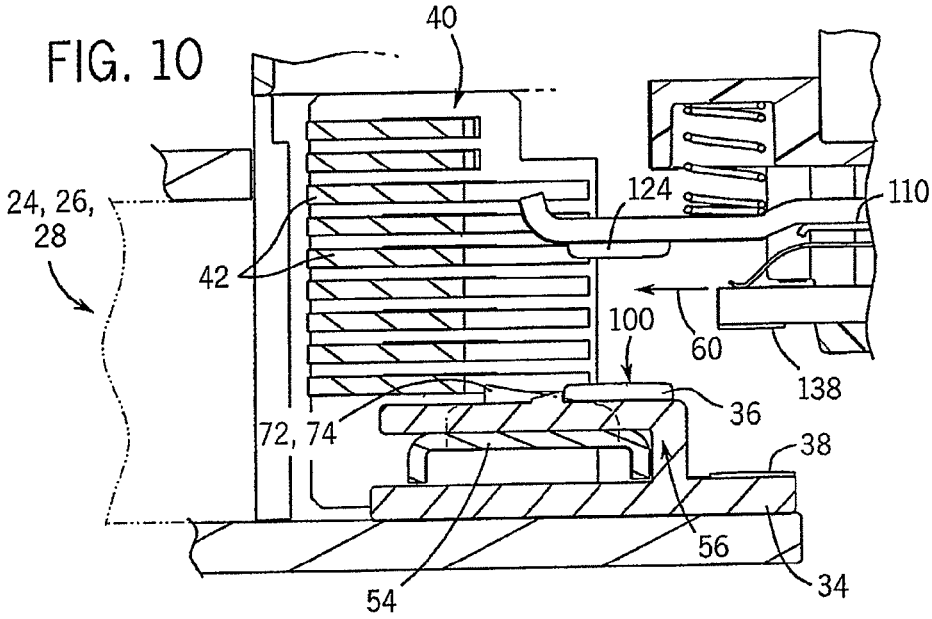
FIG. 10 is a view similar to that shown in FIG. 9 with the movable arc and carry contacts moved away from the stationary arc and carry contacts to prevent the communication of current through the contactor assembly.

As shown in FIG. 10, opening of the circuit 24, 26, 28 is achieved with the translation of moveable arc contact 124 out of engagement with stationary arc contact 36. Separation of stationary carry contact 38 and moveable carry contact 138 prior to disengagement of stationary arc contact 36 and moveable arc contact 124 ensures that any circuit termination resultant arc is generated proximate arc contacts 36, 124. The shape of turnback 56 of stationary contact 34 generates electromagnetic magnetic force 60 directed toward arc arrestor such that the arc is broken up into a plurality of arclets between adjacent plates 42 of arc arrestor 40. Magnetic intensifier 54 increases the magnitude of force 60 toward arrestor 40 and ensures expedient transfer of the arc from stationary arc contact 36 to the plates 42 of arc arrestor 40.

Figure 11:
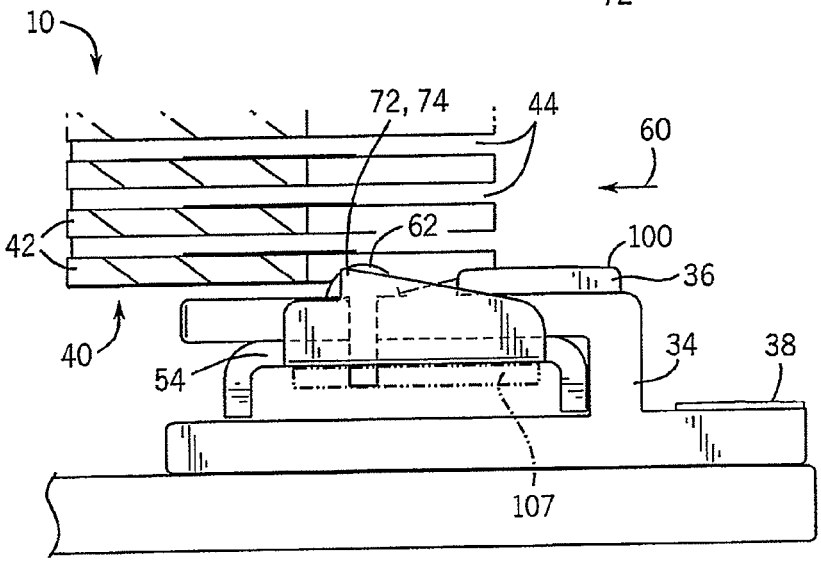
FIG. 11 is an elevational view of the stationary contact and magnetic field intensifier positioned proximate the arc arrestor of the contactor assembly shown in FIG. 10.

Referring to FIG. 11, wings 72, 74 of magnetic intensifier 54 extend above contact face 100 of stationary arc contact 36 and are constructed to attract a circuit termination arc away from the stationary arc contact 36. Accordingly, magnetic intensifier 54 is constructed to accentuate or intensify the magnitude of magnetic force 60 associated with turnback 56 in addition to providing an arc guiding or steering function for any resultant circuit termination arc away from contact face 100 of arc contact 36 toward arrestor 40. As such, regardless of whether a circuit termination arc propagates to wing 72, 74 or rivet 62, magnetic intensifier 54, in amplifying magnetic force 60, assists in the expedient transfer of a circuit termination arc from contact face 100 thereby maintaining the mechanical and electrical integrity of the stationary arc contact 36. Optional magnet 107 further enhances the arc directing ability of contactor assembly 10. Understandably, intensifier 54 and magnet 107 could be constructed of magnetically reactive materials, current magnetically reactive materials, simple magnetic materials such as natural or rare earth magnetic materials, ceramic based magnetic materials.

Figure 12:
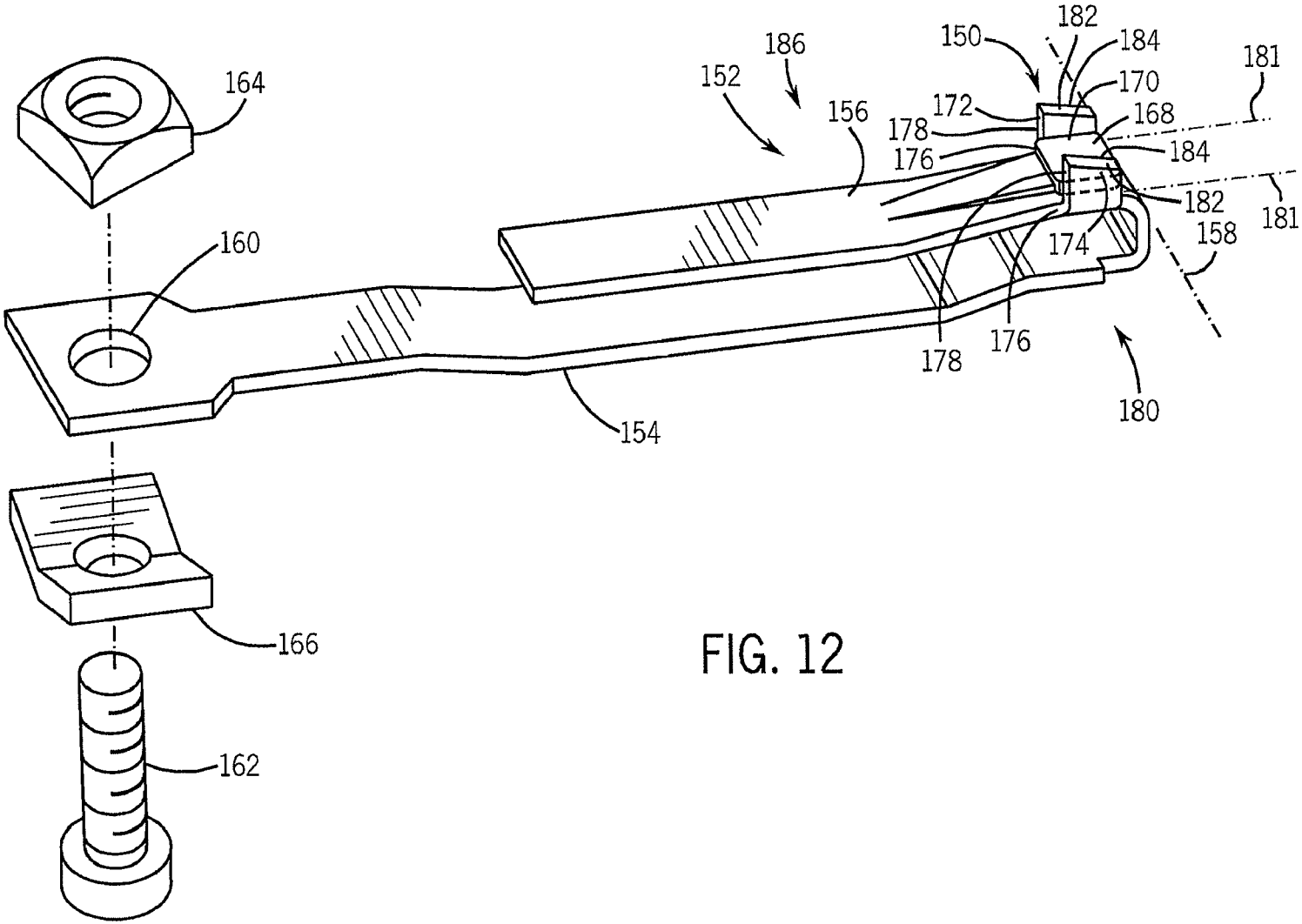
FIG. 12 is a perspective view similar to FIG. 5 of another embodiment of a magnetic intensifier according to the present invention.

FIG. 12 shows a magnetic intensifier 150 according to another embodiment of the invention. As shown in FIG. 12, a turnback 152 includes a first portion 154 and a second portion 156. First portion 154 and second portion 156 of turnback 152 are constructed to overlay one another relative to a turn axis or fold line 158. An opening or hole 160 is formed in turnback 152 and receives a fastener 162 therethrough. A nut 164 and a washer 166 cooperate to provide a secure electrical connection of turnback 152 with a supporting structure. Understandably, it is envisioned that other conductive connectors, such as spring clips or the like provide means for electrically connecting turnback 152 to the circuitry of a switch assembly.

A contact 168 is attached to turnback 152 proximate intensifier 150 and includes an upper face 170 constructed to engage a corresponding contact. Magnetic intensifier 150 includes a first arm 172 and a second arm 174 which extend from turnback 152 proximate contact 168. Each arm includes a first portion 176 which extends away from a side of turnback 152 and a second portion 178 which extends upwardly from first portion 176. Such a construction ensures that arms 172, 174 are located close enough to contact 168 to magnetically interfere with an arc that may establish without interfering with the electrical operation of contacts 168. Arms 172, 174 extend from turnback 152 generally away from an area 180 between first and second portions 154, 156 of turnback 152. Preferably, arms 172, 174 are formed by bending the portion of turnback 152 that forms the arms 172, 174 about fold lines 181 that are oriented in crossing directions with fold line 158. It is appreciated that any of the height, length, thickness, and angle of extension of arms 172, 174 may vary depending on the construction of intensifier 150, turnback 152, contactor 168 or other structures adjacent or proximate arms 172, 174. That is, it is appreciated that the shape and contour of arms 172, 174 can vary.

A terminal end 182 of each arm 172, 174 includes at least one sharp corner 184 configured to attract a contact separation resultant arc. It is further appreciated that terminal ends 182 may be tapered to direct an arc toward an arc suppressor constructed to be positioned proximate contact 168. An area 186 of turnback 152 is constructed such that an arc arrestor generally similar to arc arrestor 40 may positioned operationally proximate contact 168. It is further readily appreciated that although turnback 152 is shown as having a single contact 168, turnback 152 could be constructed with more than one contact to provide separate arc and carry contacts.

Turnback 152 is constructed of a bimetal material such that the turnback is conductive and magnetically reactive. Preferably, turnback 152 is constructed of a first material that is more conductive than a second material and the second material is more magnetically responsive than the first material. More preferably, turnback 152 is constructed of a copper clad steel material. It is further envisioned that turnback 152 be cut or stamped from a common sheet of copper clad material and bent to form turnback 152 and magnetic intensifier 150. Integration of intensifier 150 into turnback 152 simplifies the manufacture and assembly of a contact or switch assembly equipped with such a turnback and eliminates supplemental structure disposed between the respective portions 154, 156 of turnback 152.

Magnetic operation of intensifier 150 may be further augmented with the inclusion of a supplemental intensifier, generally similar to intensifier 54, disposed in area 186 between the respective portions 154, 156 of turnback 152. Independent of such a configuration, turnback 152 provides quick and repeatable separation of a circuit termination arc from contact 168. Accordingly, a contactor assembly constructed according to either of the embodiments of the present invention is constructed to withstand greater operating power and is less susceptible to arc termination and arc contact degradation.

Therefore, one embodiment of the invention includes a magnetic intensifier for use in a switch for severing an electrical circuit. The switch includes a pair of electrical contacts that separate along an axis and produce an arc along the axis between front surfaces of the contacts. At least one of the contacts provides a turnback wherein current to the contact passes along at least a partial loop passing in part behind the contact. The magnetic intensifier includes a magnetically responsive body that forms at least a portion of the turnback proximate the one contact. An arm extends from the magnetically responsive body beyond a side of one contact and proximate the one contact to manipulate magnetic flux formed by the current passing through the partial loop.

Another embodiment of the invention includes a circuit interrupter assembly that has a first contact and a second contact that is movable between a first position and a second position. The first contact and second contact are electrically connected when the second contact is located in the first position and the first contact and the second contact are electrically separated when the second contact is located in the second position. A turnback is constructed to support one of the first contact or the second contact. An intensifier extends beyond a side of the turnback proximate the one contact and is configured to concentrate magnetic flux generated by current passing through the turnback.

A further embodiment to the invention includes a method of manufacturing a switch assembly. The method includes cutting a body from a metallic material. A turnback is formed by folding the body along a first fold line such that a first portion of the body overlies a second portion of the body. The body is folded along second and third fold lines that are oriented in crossing directions with the first fold line such that the turnback is flanked by a pair of arc rails which extend in a direction away from an area bound by the first and second portions of the body. The arc rails intensify the magnetic field associated with a current passing through the turnback.

Understandably, the present invention has been described above in terms of the preferred embodiment. It is recognized that various alternatives and modifications may be made to these embodiments which are within the scope of the appending claims. It is further appreciated that the features of the multiple embodiments are no way limited solely thereto. That is, it is appreciated that one or more of the features of any one embodiment may be applicable to one or more of the other embodiments.

What is claimed is:

1. A method of manufacturing a switch assembly of a type having pairs of opposed contacts moving together and apart to make and break an electrical circuit under the influence of an electromagnetic actuator, the method comprising:

(A) cutting a body from a sheet of conductive and ferromagnetic material;

(B) folding the body along a first fold line to form a turnback wherein a first portion of the body overlies a second portion of the body;

(C) folding the first portion of the body along a second and a third fold line oriented in a crossing direction with the first fold line such that a contact location on an outer surface of the first portion is flanked by a pair of arc rails which extend substantially perpendicularly to a surface of the contact location on either side of the contact location to a sharpened edge;

(D) attaching an electrical contact to the contact location between the arc rails; and (E) tapering each sharpened edge from a first position above a contact face of a stationary contact to a second position closer to the contact face than the first position.

2. The method of claim 1 further comprising selecting the conductive and ferromagnetic material to include a first material and a second material wherein the first material is magnetic and the second material that is more electrically conductive than the first material.

3. The method of claim 2 further comprising selecting copper clad steel to form the body.

4. The method of claim 1 wherein the body is stamped from a sheet of bimetal material.

* * * * *